US006200169B1

(12) United States Patent
Tseng

(10) Patent No.: US 6,200,169 B1
(45) Date of Patent: Mar. 13, 2001

(54) WIRE CONNECTOR FOR A DECORATIVE LAMP

(76) Inventor: Jeou-Nan Tseng, No. 539, Sec. 4, Chunghua Rd., Hsinchu (TW)

( * ) Notice: Subject to any disclaimer, the term of this patent is extended or adjusted under 35 U.S.C. 154(b) by 0 days.

(21) Appl. No.: 09/428,737

(22) Filed: Oct. 28, 1999

(51) Int. Cl.[7] ..... H01R 24/00
(52) U.S. Cl. ..... 439/699.1; 439/619
(58) Field of Search ..... 439/699.1, 699.2, 439/619, 930; 362/123, 226

(56) References Cited

U.S. PATENT DOCUMENTS 5,700,082 * 12/1997 Peng ..... 439/619
5,791,940 * 8/1998 Chen et al. ..... 439/699.2
5,879,195 * 3/1999 Cheng ..... 439/619
5,989,047 * 11/1999 Huang ..... 439/699.2
6,043,593 * 3/2000 Pan ..... 439/619

* cited by examiner

*Primary Examiner*—T. C. Patel
(74) *Attorney, Agent, or Firm*—Thomas, Kayden, Horstemeyer & Risley LLP

(57) ABSTRACT

A wire connector for decorative lamp is disclosed. The wire connector is composed of a casing and a plug to be inserted into the casing. The casing has a central passage and two channels to receive the plug and two conducting elements. The plug has a broad top portion and a narrow bottom portion. A longitudinal bore is defined through the plug and two chambers are defined through the top portion of the plug. The chambers receive wires and conducting strips therein. When the plug is inserted in the casing, the conducting elements in the channels are electrically connected with the conducting strips in the corresponding chambers, then the corresponding wires in the casing and in the plug are also in electrical connection with each other.

7 Claims, 7 Drawing Sheets

WIRE CONNECTOR FOR A DECORATIVE LAMP

BACKGROUND OF THE INVENTION

1. Field of the Invention

The present invention is related to a wire connector for a decorative lamp, and more particularly to a wire connector with which bulbs can be safely and easily fitted to a decorative lamp.

2. Description of Related Art

Referring to FIG. 7, a conventional cascade decorative lamp has a primary electric cable (90) and a plurality of secondary electric cables (92) electrically connected with the primary electric cable (90). Bulbs (94) are provided on the secondary electric cables (92). When the cascade decorative lamp is horizontally suspended, it seems to be a light waterfall and provides an attractive decorative effect.

In the conventional cascade decorative lamp, the primary electric cable (90) is formed by a plurality of wires twisted together. The secondary electric cables (92) are wires extended from the primary electric cable (90). There are two methods to assemble the decorative lamp.

The first method is to twist wires each having bulbs (94) pre-assembled thereon together to form the decorative lamp as shown in FIG. 7. This process must be performed by hand and is very time-consuming.

The second method is to respectively manufacture the primary electric cable (90) and the secondary electric cables (92), and then electrically connect the secondary electric cables (92) to the primary electric cable (90). There are also problems existing in connecting the secondary electric cables (92) to the primary electric cable (90). If the secondary electric cables (92) are directly electrically connected to the primary electrical cable (90), this also needs a long time and is not efficient. If the secondary electric cables (92) are directly connected to the primary electrical cable (90) by a conventional wire connector, it will not provide proper structure strength for suspension. Moreover, if it rains, there will be water remaining in the wire connector and thus, it is easy for short circuits to occur in the wire connector.

Therefore, it is an objective of the invention to provide a wire connector for the decorative lamp to mitigate and/or obviate the aforementioned problems.

SUMMARY OF THE INVENTION

The main objective of the present invention is to provide a wire connector for a decorative lamp with which a bulb can be easily fitted to a primary electrical cable of the decorative lamp;

Another objective of the present invention is to provide a wire connector for a decorative lamp which drains well in wet weather to avoid short circuits therein.

Other objects, advantages and novel features of the invention will become more apparent from the following detailed description when taken in conjunction with the accompanying drawings.

| | |
|---|---|
| 10 - casing | 12 - central passage |
| 120 - chamber | 14 - hollow projection |
| 140 - cavity | 22 - longitudinal bore |
| 20 - plug | 222 - exit |
| 220 - channel | 240 - opening |
| 24 - barb | 28 - step |
| 26 - slot | 32 - conducting strip |
| 30 - electrical wire | 92 - secondary electrical cable |
| 34 - conducting element | |
| 90 - primary electrical cable | |
| 94 - bulb | |

DETAILED DESCRIPTION OF THE PREFERRED EMBODIMENT

Figure 1:
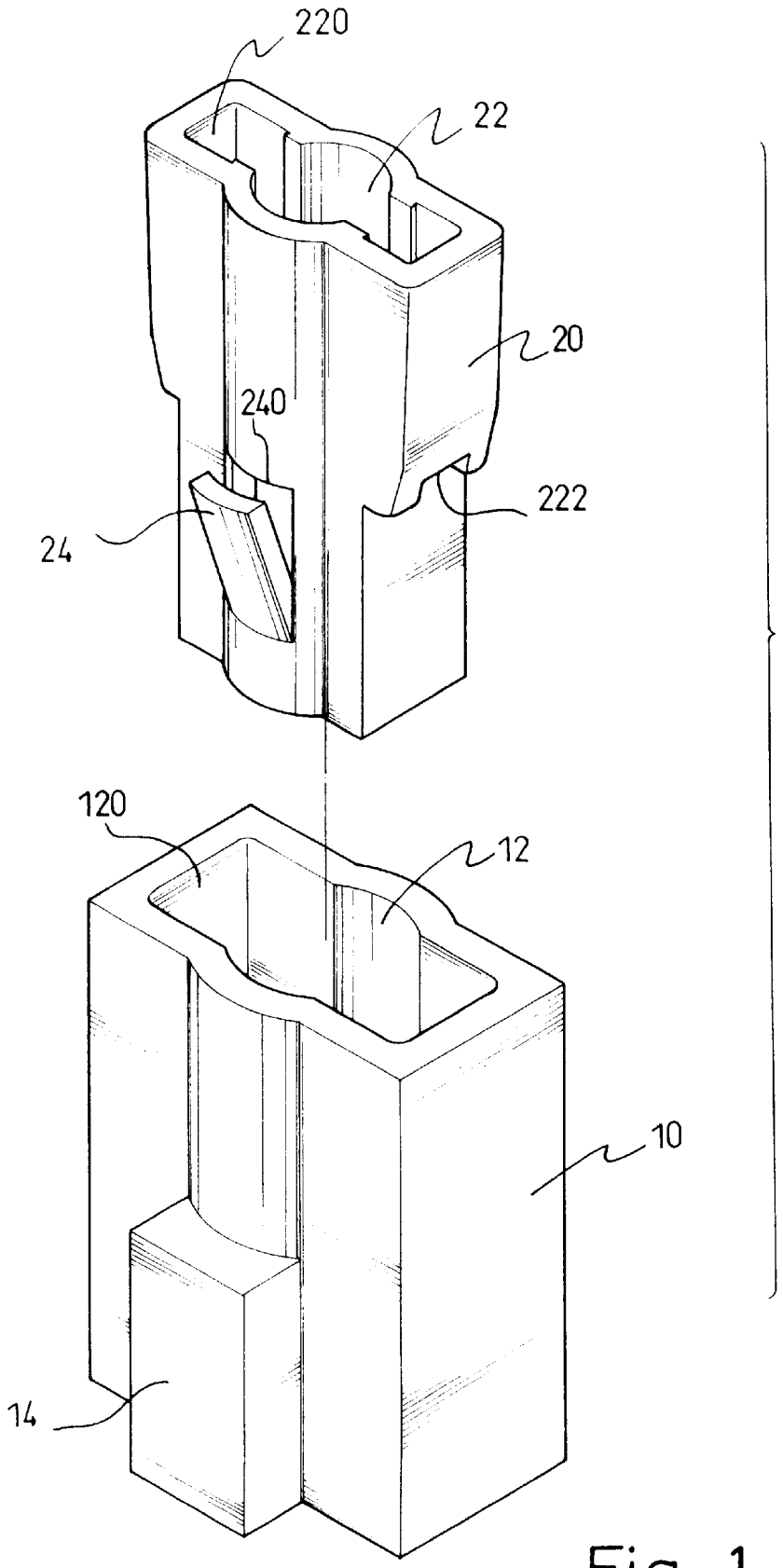
FIG. 1 is an exploded perspective view of a wire connector for a decorative lamp in accordance with the present invention.

Referring to FIG. 1, a wire connector in accordance with the present invention comprises a casing (10) and a plug (20) to be inserted into the casing (10). The casing (10) is hollow with two opposite long side walls and two opposite end walls. A central passage (12) is defined longitudinally down the casing (10) and has two channels (120) respectively defined on opposite sides thereof and in communication therewith. Each side wall has a longitudinal ridge formed therealong, which terminates in a hollow projection (14) defining a cavity (140).

The plug (20) has two opposite wide outer faces each with a central rib, and two narrow outer faces. The plug (20) also has a broad top portion, a bottom portion narrower than the top portion, and two shoulders respectively formed in the narrow outer faces and separating the top and bottom portions. A longitudinal bore (22) is defined in the center of the plug (10) and two chambers (220) are respectively defined on opposite sides of the bore (22) and are in communication therewith. The plug (20) is configured to be snugly received in the casing (10) by entering the bottom portion first in the top end of the casing (10). The two chambers (220) extend down the top portion only and terminate in downward exits (222) respectively defined in the shoulders and which communicate the interior of the plug (20) with its exterior. Two resilient barbs (24) respectively protrude outward from the ribs and at the lower portion of the plug (20). An opening (240) is defined in each rib and behind the corresponding barb (24). In an extended condition of the barbs (24), the distance from the distal tip of one barb (24) to the distal tip of the other is greater than the diameter of the central passage (12). When the plug (20) is inserted in the casing (10), the barbs (24) are first compressed by the wall defining the central passage (12) and then released when entering the cavities (140) whereby they resume their extended condition and abut end faces defining the cavities (140), thereby locking the plug (20) in the casing (10). When the barbs (24) are compressed towards each other, they enter the respective opening (240).

Figure 2:
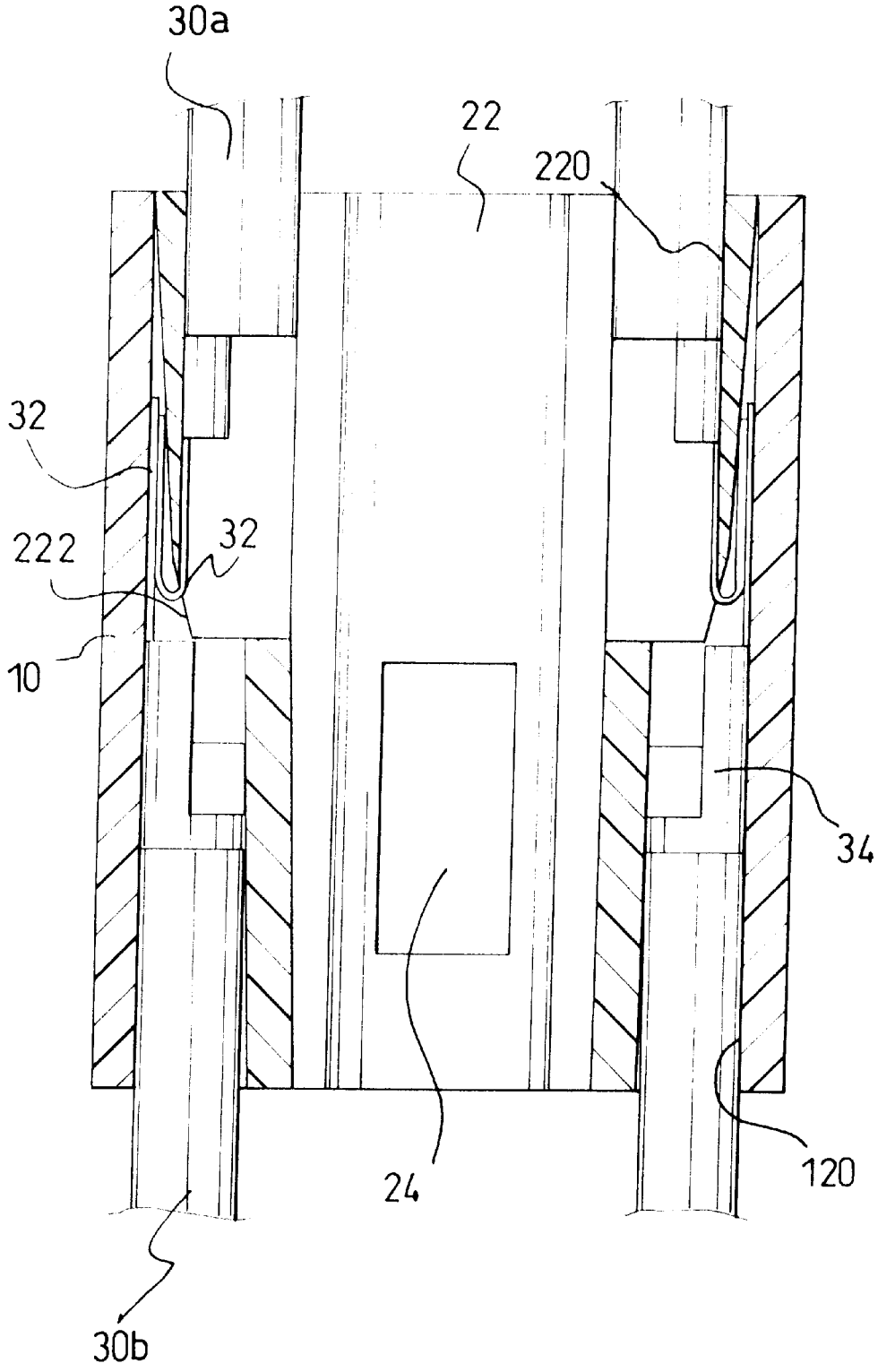
FIG. 2 is a cross sectional view of the wire connector for the decorative lamp in accordance with the present invention.
Figure 3:
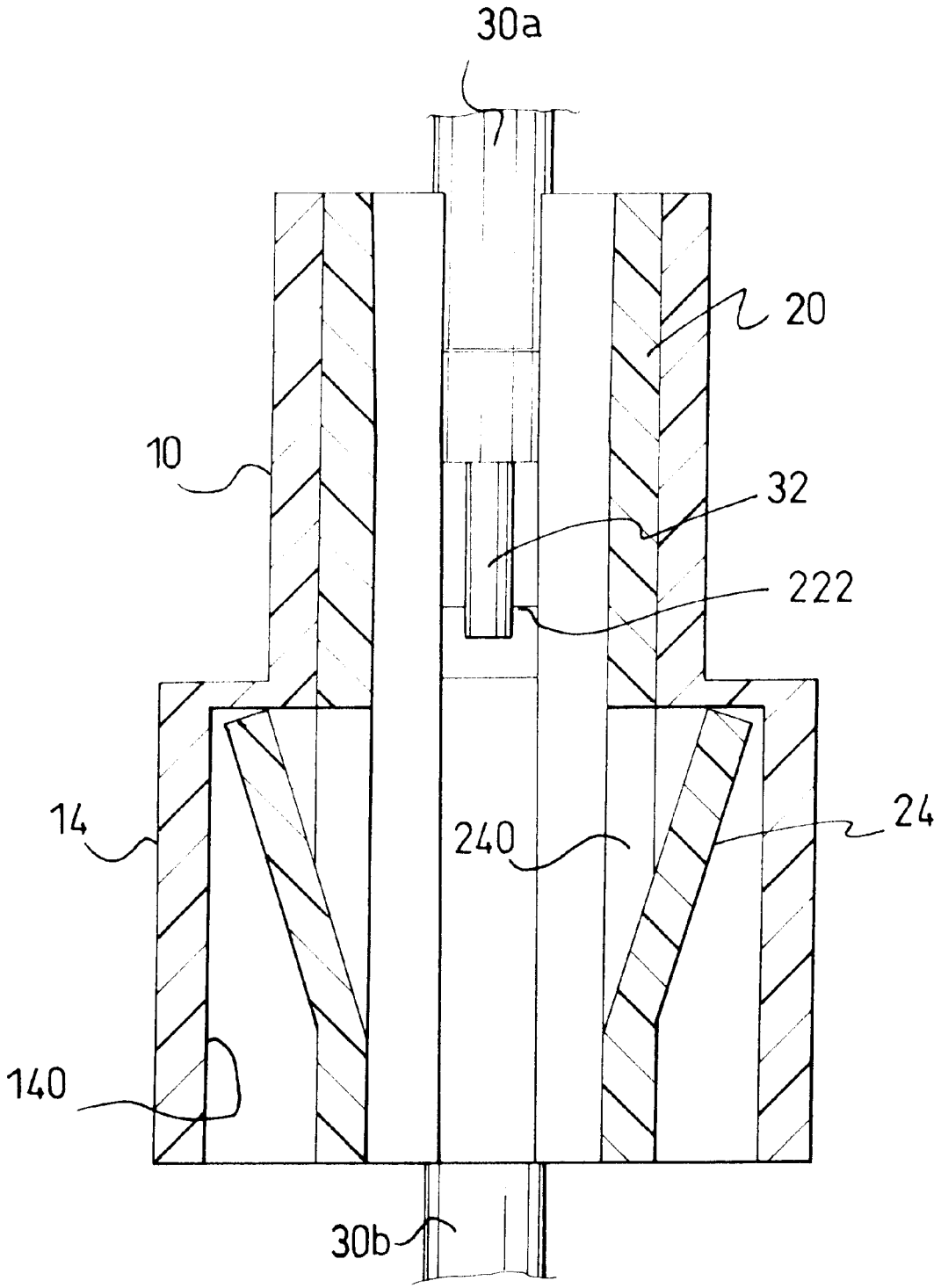
FIG. 3 is a cross sectional side view of the wire connector for the decorative lamp in accordance with the present invention.

Referring to FIGS. 2 and 3, the plug (20) has two conductive strips (32) securely extending down respective the chamber (220) and exit (222), and at the bottom of the exits (222) each conductive strip (32) is deformed upwardly to follow the respective narrow outer face. Two first electrical wires (30*a*) respectively extend downward through the tops of the chambers (220) to conductively connect to the conductive strips (32).

The casing (10) has two conductive elements (34) securely disposed in respective channel (120). Two first electrical wires (30*b*) respectively extend upward through bottoms of the channels (120) to conductively connect with the conductive elements (34).

In assembly, still referring to FIGS. 2 and 3, the plug (20) is received in the casing (10), whereby the barbs (24) are extended into the respective cavity ( 140), and the conductive strips (32) electrically contact the respective conductive element (34).

When a user wants to detach the plug (20) from the casing (10), a tool is used to compress together the barbs (24) via the bottom of the central passage (12) and the plug (20) is pulled away from the casing (10).

In practice, a plurality of the casings (10) are attached on a primary electrical cable of a decorative lamp, and bulbs (not shown) are respectively electrically connected with the corresponding plugs (20). By inserting the plugs (20) into the casings (10), the bulbs can be easily and safely assembled together to form the decorative lamp.

Figure 4:
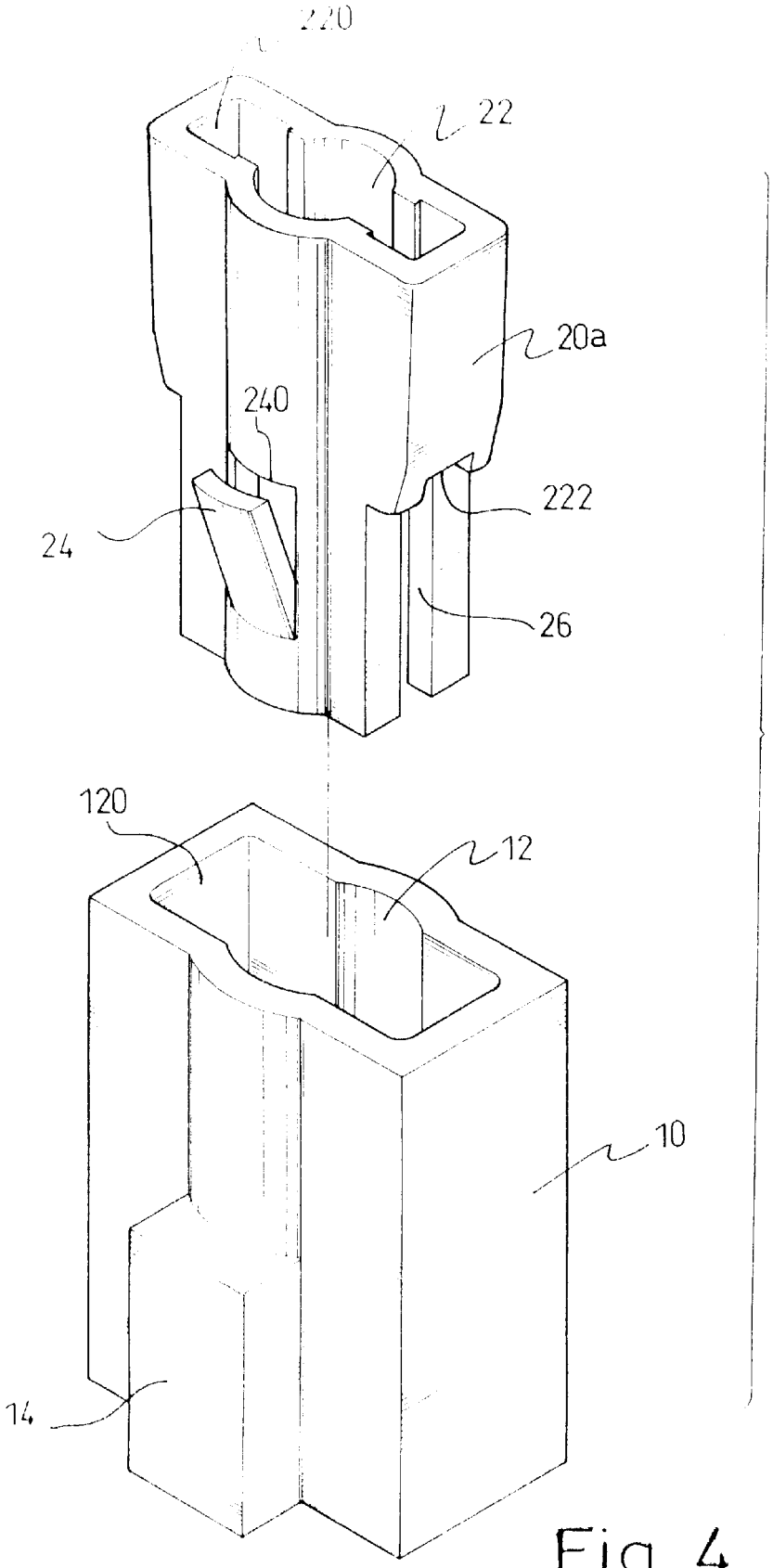
FIG. 4 is an exploded perspective view of a second embodiment of the present invention.

FIG. 4 shows a second embodiment of the present invention. In this embodiment, the bottom portion of the plug (20*a*) further comprises a slot (26) defined through each narrow outer face and in communication with the respective chamber (220) and respective exit (222).

Figure 5:
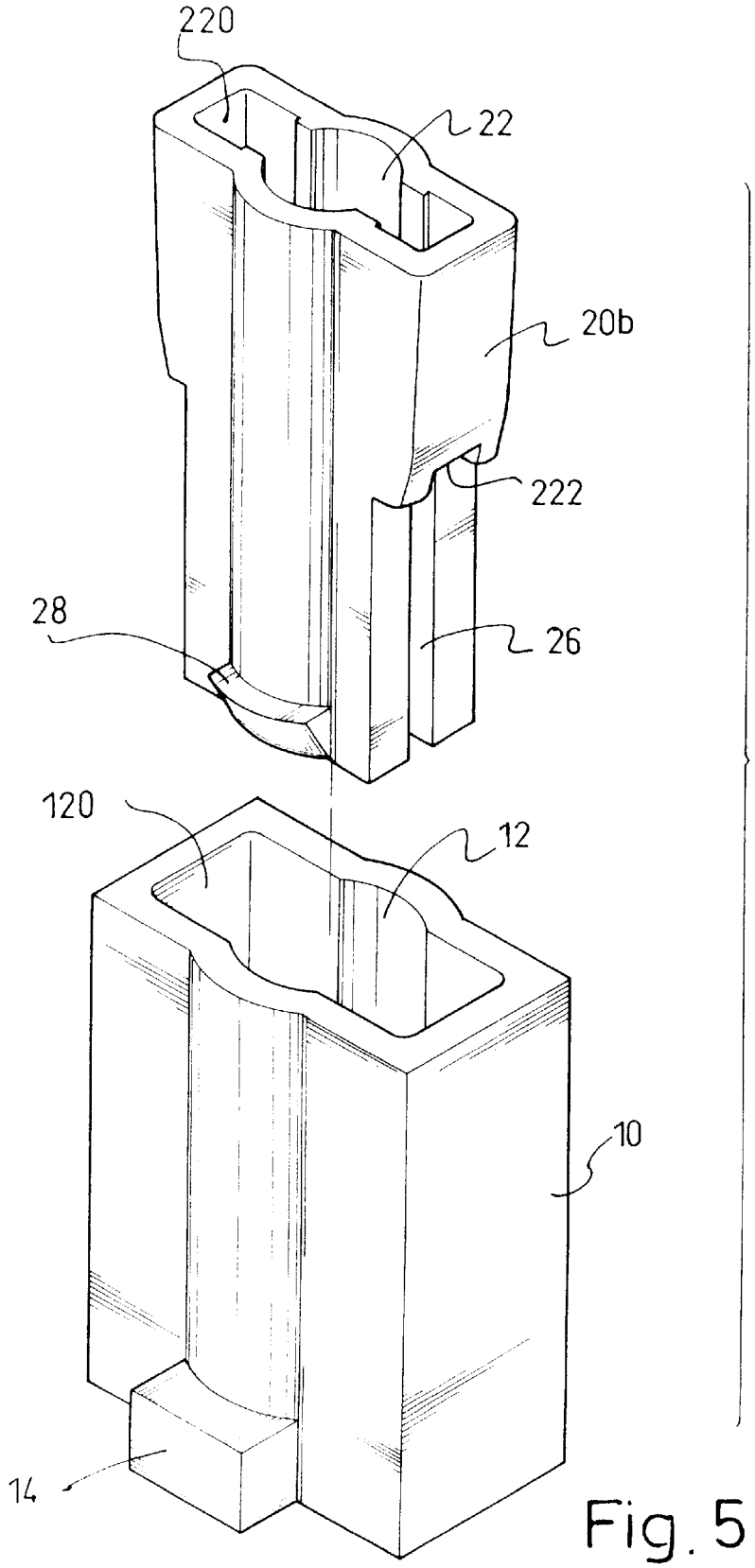
FIG. 5 is an exploded perspective view of a third embodiment of the present invention.

FIG. 5 shows a-third embodiment of the present invention. In this embodiment, the plug (20*b*) has two steps (28) respectively formed at a bottom of each longitudinal rib , but lacks the openings (240) of the first embodiment. A slot (26) is defined through the lower portion of each narrow outer face and communicates with the longitudinal bore (22), whereby the lower portion has resilience. The steps (28) can move toward each other when the bottom portion of the plug (20*b*) is inserted in the casing (10) due to the resilience hereof. In assembly, the bottom portion of the plug (20*b*) is pressed to decrease the width of the slot (26), whereafter the plug (20*b*) can smoothly enter the casing (10) and the steps (28) are then received in the cavities (140) to fixedly assemble the plug (20*b*) in the casing (10).

Figure 6:
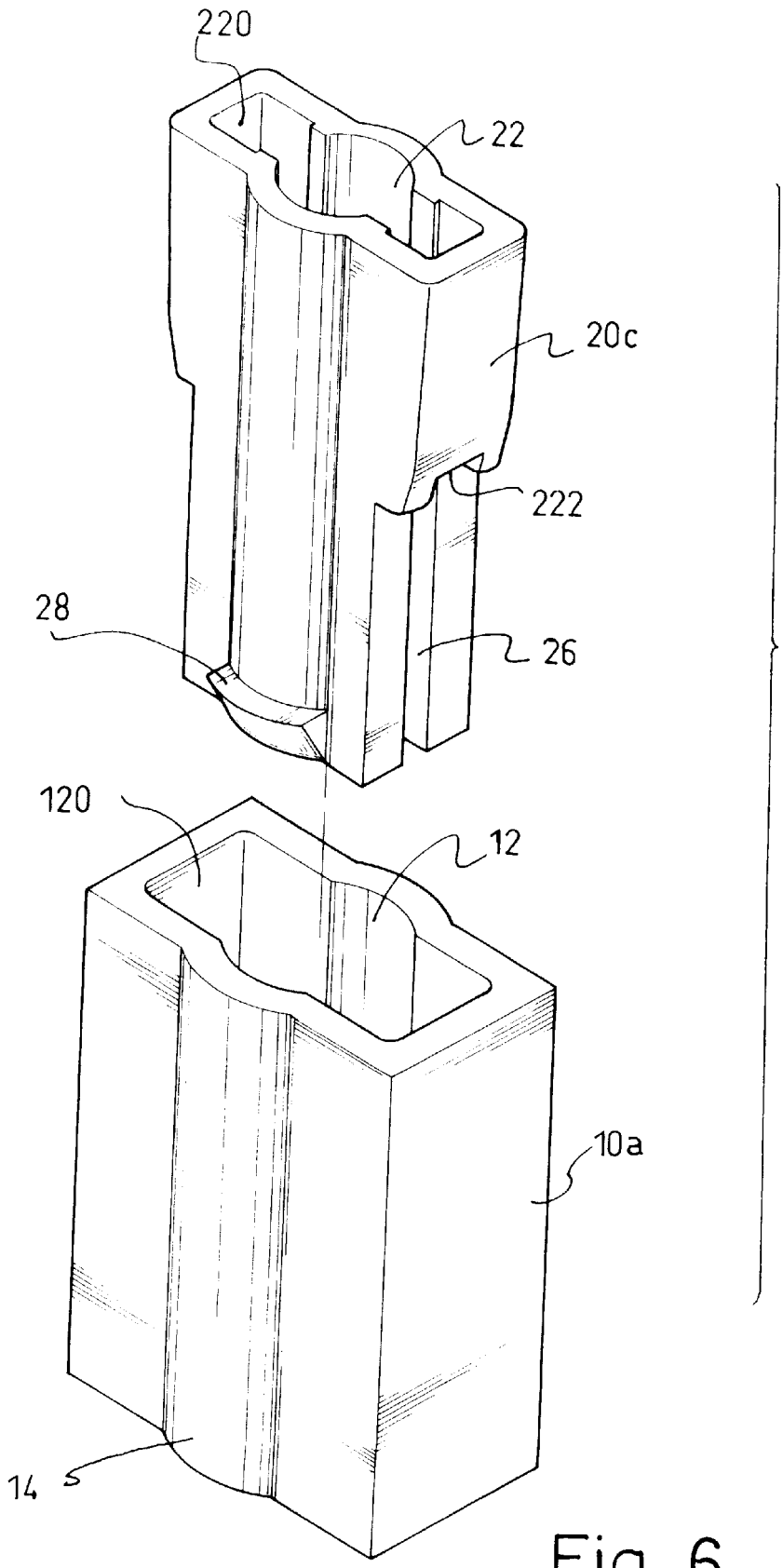
FIG. 6 is an exploded perspective view of a fourth embodiment of the present invention.
Figure 7:
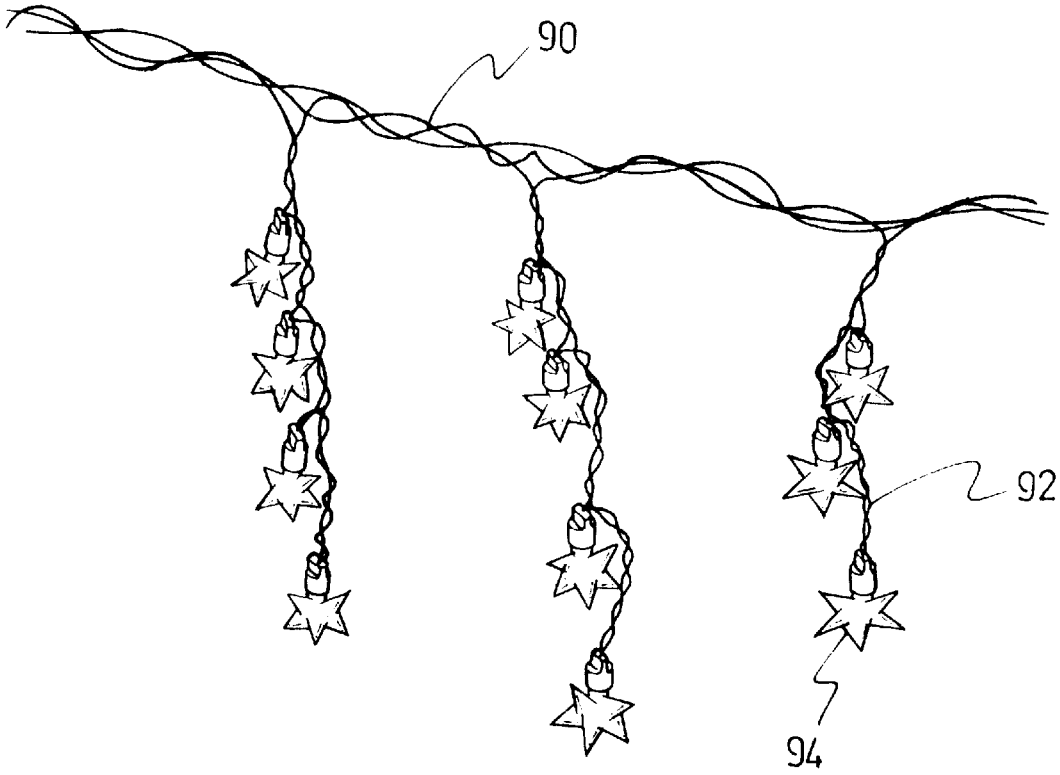
Fig. 7 Prior Art
FIG. 7 is a perspective view of a conventional cascade decorative lamp.

FIG. 6 shows a fourth embodiment of the present invention. In this embodiment, the plug (20*c*) has the steps (28) formed in the lower portion thereof and the slot (26) in communication with the longitudinal bore (22). However, the casing (10*a*) lacks the protrusions (14) and the cavities (140). The bottom portion of the plug (20*c*) has a length such that a distal tip thereof with two opposite steps (28) protrudes from the bottom of the casing (10*a*) when the plug (20*c*) is fitted therein, whereby the steps (28) engagingly abut the bottom edge of the casing (10*a*). Thus the plug (20*c*) is securely but releaseably received in the casing (10*a*).

From the above description, it is noted that the invention has the following advantages:

1. It is easy to assemble bulbs to a primary electrical cable of a decorative lamp without having to twist wires.
2. In wet weather, water will drain from the longitudinal bore (22) and the central passage (12) and not accumulate in the wire connector, so it is impossible to have short circuit.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A wire connector for decorative lamp comprising:

a casing (10) having a central passage (12) and two channels (120) defined therethrough;

a plug (20) with two opposite wide outer faces, two narrow outer faces, a broad top portion, and a bottom portion which is inserted in the casing (10), a longitudinal bore (22) defined therethrough, and two chambers (220) defined through the broad top portion and each having an exit (222) at the bottom thereof and extending to the respective narrow outer face; a first set of wires (30*a*) respectively entering the chambers (220) via of the plug (20);

a second set of wires (30*b*) respectively entering the channels (120) via the bottom of the casing (10); two conducting elements (34) respectively provided in the channels (120) and electrically connected with the second set of wires (30*b*) in the channels (120);

two conducting strips (32) respectively provided in the chambers (220) and electrically connected with the first set of wires (30*a*) in the chambers (220); and wherein the casing (10) further comprises two opposite long side walls and two opposite end walls, two hollow projections (14) respectively formed on at the long side walls, and two cavities (140) respectively defined within the projections (14) and the plug (20) further comprises two flexible barbs (24) respectively formed on the wide outer faces thereof and received in the cavities (140) when the plug (20) is received in the casing (10).

2. The wire connector as claimed in claim 1, wherein the plug (20*a*) further comprises a slot defined through each narrow outer face and in communication with the respective chamber (220) defined therein.

3. The wire connector as claimed in claim 2, wherein the bottom portion of the plug (20*c*) has a length such that a distal tip thereof with two opposite steps (28) protrudes from the easing (10*a*) when the plug (20*c*) is fitted therein, whereby the steps (28) engagingly abut the bottom edge of the casing (10*a*).

4. A wire connector for decorative lamp comprising:

a casing (10) having a central passage (12) and two channels (120) defined therethrough;

a plug (20) with two opposite wide outer faces, two narrow outer faces, a broad top portion, and a bottom portion which is inserted in the casing (10), a longitudinal bore (22) defined therethrough, a two chambers (220) defined through the broad top portion and each having an exit (222) at the bottom thereof and extending to the respective narrow outer face; a first set of wires (30*a*) respectively entering the chambers (220) via the top of the plug (20);

a second set of wires (30*b*) respectively entering the channels (120) via the bottom of the casing (10); two conducting elements (34) respectively provided in the channels (120) and electrically connected with the second set of wires (30*b*) in the channels (120); and two conducting strips (32) respectively provided in the chambers (220) and electrically connected with the first set of wires (30*a*) in the chambers (220); wherein the conducting strips (32) in the chambers (220) are extended out from the respective exit (222) and bent outwards to be fixed on the outer wall of the respective chamber (220);

wherein the casing (10) further comprises two opposite long side walls and two opposite end walls, two hollow projections (14) respectively formed on at the long side walls, and two cavities (140) respectively defined within the projections (14) and the plug (20) further comprises two flexible barbs (24) respectively formed on the wide outer faces thereof and receive in the cavities (140) when the plug (20) is received in the casing (10);

wherein the plug (20*a*) further comprises a slot defined through each narrow outer face and in communication with the respective chamber (220) defined therein.

5. The wire connector as claimed in claim 4, wherein the bottom portion of the plug (20*c*) has a length such that a distal tip thereof with two opposite steps (28) protrudes from the casing (10*a*) when the plug (20*c*) is fitted therein, whereby the steps (28) engagingly abut the bottom edge of the casing (10*a*).

6. A wire connector for decorative lamp comprising:

a casing (10) having a central passage (12) and two channels (120) defined therethrough;

a plug (20) with two opposite wide outer faces, two narrow outer faces, a broad top portion, and a bottom portion which is inserted in the casing (10), a longitudinal bore (22) defined therethrough, and two chambers (220) defined through the broad top portion and each having an exit (222) at the bottom thereof and extending to the respective narrow outer face; a first set of wires (30*a*) respectively entering the chambers (220) via the top of the plug (20);

a second set of wires (30*b*) respectively entering the channels (120) via the bottom of the casing (10); two conducting elements (34) respectively provided in he channels (120) and electrically connected with the second set of wires (30*b*) in the channels (120); and two conducting strips (32) respectively provided in the chambers (220) and electrically connected with the first set of wires (30*a*) in the chambers (220); wherein the conducting strips (32) in the chambers (220) are extended out from the respective exit (222) and bent outwards to be fixed on the outer wall of the respective chamber (220);

wherein the casing (10) further comprises two opposite long side walls and two opposite end walls, two hollow projections (14) respectively formed on at the long side walls, and two cavities (140) respectively defined within the projections (14) and the plug (20) further comprise two flexible barbs (24) respectively formed on the wide outer faces thereof and receive in the cavities (140) when the plug (20) is received in the casing (10);

wherein the plug (20*a*) further comprises a slot defined through each narrow outer face and in communication with the respective chamber (220) defined therein; and wherein the casing (10) further comprises two opposite long side walls and two opposite end walls, each long side wall having a hollow projection (14) at the bottom thereof, each hollow projection (14) defining a cavity (140) therein and in communication with the central passage (12), and the plug (20*b*) further comprises two steps (28) respectively formed on the opposite outer surfaces thereof and received in the recesses (140) when inserting the plug (20*b*) into the casing (10).

7. The wire connector as claimed in claim 6, wherein the bottom portion of the plug (20*c*) has a length such that a distal tip thereof with two opposite steps (28) protrudes from the casing (10*a*) when the plug (20*c*) is fitted therein, whereby the steps (28) engagingly abut the bottom edge of the casing (10*a*).

* * * * *